US010342297B2

(12) United States Patent
Fukui et al.

(10) Patent No.: US 10,342,297 B2
(45) Date of Patent: Jul. 9, 2019

(54) BELT BUCKLE AND BELT

(71) Applicant: Polymer Gear Co., Ltd., Maibara (JP)

(72) Inventors: Hiroaki Fukui, Maibara (JP); Hirotaka Fukui, Maibara (JP); Naoyuki Hase, Maibara (JP)

(73) Assignee: Polymer Gear Co., Ltd., Maibara-shi, Shiga (JP)

( * ) Notice: Subject to any disclaimer, the term of this patent is extended or adjusted under 35 U.S.C. 154(b) by 193 days.

(21) Appl. No.: 15/623,888

(22) Filed: Jun. 15, 2017

(65) Prior Publication Data

US 2018/0000202 A1 Jan. 4, 2018

(30) Foreign Application Priority Data

Jun. 30, 2016 (JP) ..... 2016-003117

(51) Int. Cl.
*A44B 11/12* (2006.01)
*A41F 9/00* (2006.01)

(52) U.S. Cl.
CPC ..... *A44B 11/12* (2013.01); *A41F 9/002* (2013.01)

(58) Field of Classification Search
CPC ..... A41F 9/002; A44B 11/12
USPC ..... 2/322
See application file for complete search history.

(56) References Cited

U.S. PATENT DOCUMENTS 5,577,300 A * 11/1996 Gutrugianios ..... A44B 11/12 24/170
9,918,522 B2 * 3/2018 Laatz ..... A41F 9/025
2011/0247179 A1 * 10/2011 Bellamy ..... A61B 17/1327 24/19
2017/0258160 A1 * 9/2017 Rowland ..... A44B 11/12

FOREIGN PATENT DOCUMENTS

JP H 10-174606 A 6/1998
JP 2013-138796 A 7/2013
JP 3188048 U 12/2013
WO WO 2015/001604 A1 1/2015

* cited by examiner

*Primary Examiner* — Katherine M Moran
(74) *Attorney, Agent, or Firm* — Muncy, Geissler, Olds & Lowe, P.C.

(57) ABSTRACT

Base and cover members 3, 8 are pivotally connected by a pin 13. The cover member can be rotated between an opened position and a closed position. A stopper member 9 with first and second claws is mounted on the pin to rotate around the pin. The cover member has an engagement wall 7. An end 15*b* of a belt 15 is inserted through the cover member, the cover member is rotated from the opened position to the closed position, and the belt is pulled in a direction of drawing the belt out of the belt buckle, and thereby, the belt is locked between the second claws and a bottom wall 5 of the cover member. At the same time, the rotational moment rotating the cover member toward the closed position is generated by the engagement wall of the cover member being pressed by the belt.

3 Claims, 6 Drawing Sheets

BELT BUCKLE AND BELT

CROSS REFERENCE TO RELATED APPLICATIONS

This application claims priority of Application No. 2016-003117 filed in Japan on Jun. 30, 2016 under 35 U.S.C. § 119; the entire contents of all of which are hereby incorporated by reference.

FIELD OF THE INVENTION

The present invention relates to a belt buckle and a belt provided with the belt buckle.

BACKGROUND OF THE INVENTION

JP 2013-138796 A discloses a belt buckle having base and cover members which overlap and are pivotally connected to each other by a pin in such a way that the cover member is rotatable around the pin between an opened position and a closed position. The base member has a belt holding mechanism cooperating with the second bottom wall of the cover member in the closed position of the cover member.

The belt holding mechanism comprises a restraint wall connecting to one end of the first bottom wall of the base member, and a stopper member mounted on the pin so as to rotate around the pin and extended between a pair of first side walls of the base member. The stopper member has a bottom surface, a pair of side surfaces, a pair of end surfaces, an upper surface, and a through hole extending through the end surfaces in a longitudinal direction of the stopper member.

A transition portion from one of the side surfaces to the bottom surface forms a convex surface, and the one of the side surfaces faces toward the restraint wall, and the pin passes through the through hole. At least one claw and at least one second claw are provided on the top surface of the stopper member.

Then, in the closed position of the cover member, the first claw(s) bite(s) into the belt while the stopper member is kept at rest, whereby a belt is engaged between the first claw(s) and the second bottom wall of the cover member. In this position, when the belt is pulled in a direction of drawing the belt out of the belt buckle, the stopper member rotates while bringing the transition portion into contact with the first bottom wall until the stopper member abuts to the restraint wall, and thereby the second claw(s) bite(s) into the belt deeper than the first claw(s) while the first claw(s) separate(s) from the belt so that the belt is locked between the stopper member and the cover member.

According to this belt buckle, a belt is easily secured to the belt buckle without using a biasing member such as a spring only by rotating the cover member from the opened position to the closed position and pulling the belt in the direction of drawing the belt out of the belt buckle. Further the lock of the belt can be easily released only by rotating the cover member from the closed position to the opened position and the belt can be easily detached from a user's waist.

In this configuration, when a user fastens the belt around his (her) waist, the belt extends in a flat from the stopper member to a belt inlet of the cover member while contacting the interior surface of the cover member, and thereby, the cover member can be prevented from rotating toward the opened position.

However, the belt together with the cover member can bend toward the opened position of the cover member depending on a manner of supporting the belt by the user's waist.

In this belt buckle, it is uncertain to hold the cover member in the closed position when the user fastens the belt to his(her) waist. Therefore, the cover member can be opened suddenly while the belt is fastened around the user's waist, so that the belt is wound down or detached from the user's waist.

JP 3188048 U discloses a belt body of a belt. The belt body comprises a stretch core sandwiched between front and back sheet materials which are made of natural leather. Each of the front and back sheet materials is bonded with the core through an adhesive, and the front and back sheet materials are stitched at both sides thereof.

However, production of this belt body is fairly costly, so that the use of this belt body raises production costs of belts.

SUMMARY OF THE INVENTION

It is, therefore, an object of the present invention to provide a belt buckle which can achieve a stable wear of a belt as well as a low cost production.

It is another object of the present invention to provide a belt capable of being manufactured at low cost.

In order to achieve the objects, the present invention provides a belt buckle comprising: a base member formed by a first bottom wall, a pair of first side walls connecting to both sides of the first bottom wall, and a restraint wall connecting to one end of the first bottom wall and extending from the first bottom wall on the same side as the first side walls; a cover member formed by a second bottom wall which is wider than the first bottom wall, a pair of second side walls connecting to both sides of the second bottom wall, and an engagement wall connecting to one end of the second bottom wall and extending between the second side walls, the cover member and base member overlapping in such a way that interior surfaces of the cover member and base member are opposed to each other and the engagement wall protrudes outwardly from the restraint wall; a pin extending through the first and second side walls in a width direction of the base member at a side of the one end of the base member so as to pivotally connect the cover member and base member, the cover member being rotatable around the pin between a closed position in which the cover member overlaps with the base member and an opened position in which the cover member separates from the base member; a belt attachment mechanism arranged at the other end of the base member for fixing one end of a belt to the base member; and a belt holding mechanism arranged at the base member for cooperating with the second bottom wall of the cover member in such a way that the belt inserted between the second side walls is engaged between the belt holding mechanism and the interior surface of the second bottom wall when the cover member is arranged at the closed position, and for releasing the engagement of the belt when the cover member is arranged at the opened position, the belt holding mechanism comprising: the restraint wall of the base member; and an elongated stopper member mounted on the pin so as to rotate around the pin and extended between the first side walls, the stopper member having: a flat bottom surface; a pair of side surfaces connecting to both sides of the bottom surface; a pair of end surfaces connecting to both ends of the bottom surface; an upper surface connecting the side surfaces and the end surfaces; a through hole extending through the end surfaces in a longitudinal direction of the stopper member, a transition portion from one of the side surfaces to the bottom surface forming a convex surface, the one of the side surfaces facing toward the restraint wall, the pin passing through the through hole; and at least one first claw and at least one second claw provided on the top surface of the stopper member in such a way that the at least one first claw is arranged closer to the restraint wall than the at least one second claw in the rotary direction of the stopper member.

According to the present invention, the belt is wound around a user's waist, the belt (the other end thereof) is inserted through the belt buckle in the opened position of the cover member. Then the cover member is rotated from the opened position to the closed position, where the first claw(s) bite(s) into the belt while the stopper member is kept at rest so that the belt is engaged between the first claw(s) and the second bottom wall of the cover member.

Thereafter the belt is pulled in a direction of drawing the belt out of the belt buckle, and the stopper member rotates while bringing the transition portion into contact with the first bottom wall until one of the side surfaces of the stopper member abuts to the restraint wall, and thereby the second claw(s) bite(s) into the belt deeper than the first claw(s) while the first claw(s) separate(s) from the belt so that the belt is locked between the stopper member and the cover member.

At the same time, the belt is pressed by an top surface of the engagement wall of the cover member against the user's waist in such a way that the belt extends with curvature from the stopper member to the top surface of the engagement wall. Thus the rotational moment rotating the cover member toward the closed position is generated by the stress to the curvature of the belt so as to certainly hold the cover member in the closed position. Consequently, the belt is neither wound down nor detached from the user's waist while the belt is fastened around the user's waist.

Further, according to the present invention, a structure of a belt buckle becomes simpler than that of a conventional belt buckle because a biasing means such as a spring is not required and the number of components of the belt buckle is reduced. So the low-cost production of belt buckles is achieved.

According to a preferred embodiment of the present invention, each of the first side walls of the base member has a step on an upper corner thereof at the one end of the base member, and wherein the restraint wall has protrusions at its both sides in a width direction of the base member, each of the protrusions extending into the associated step so as to be supported by the associated step at an underside thereof.

In order to achieve the objects, the present invention also provides a belt comprising: the above-mentioned belt buckle; and a belt body, the belt body having: a core composed of a woven fabric consisting of twisted yarns of short fibers, the twisted yarns having a fluffed surface; and a synthetic resin layer covering the whole of the core.

According to the present invention, it is possible to produce the belt body of the belt by use of a molding process which includes supplying melted synthetic resin into a mold and continuously drawing the core out of the mold, and thereby a production process of the belt body becomes simpler than that of a conventional belt body, and thereby the cost of production of the belt body is considerably reduced.

In addition, the core of the belt body adheres tightly to the synthetic resin layer because the core has fluffed surface, and the belt body has a level of flexibility and strength because the core is composed of the woven fabric consisting twisted yarns of short fibers. Consequently, the belt provides good wear feeling and high durability.

DETAILED DESCRIPTION OF PREFERRED EMBODIMENT

A preferred embodiment of the present invention will be described below with reference to accompanying drawings.

Figure 1:
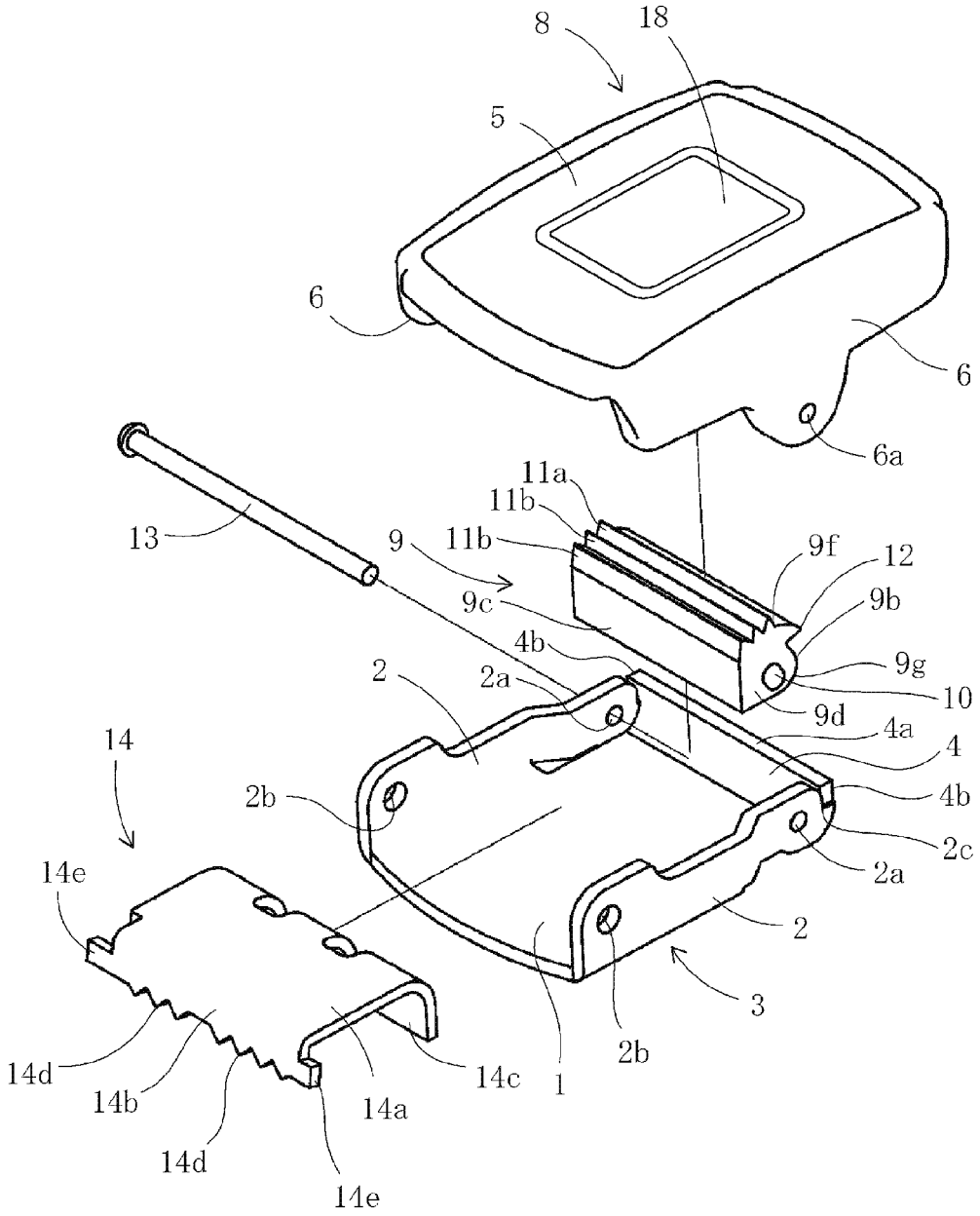
FIG. 1 is an exploded perspective view of a belt buckle according to an embodiment of the present invention.
Figure 2A:
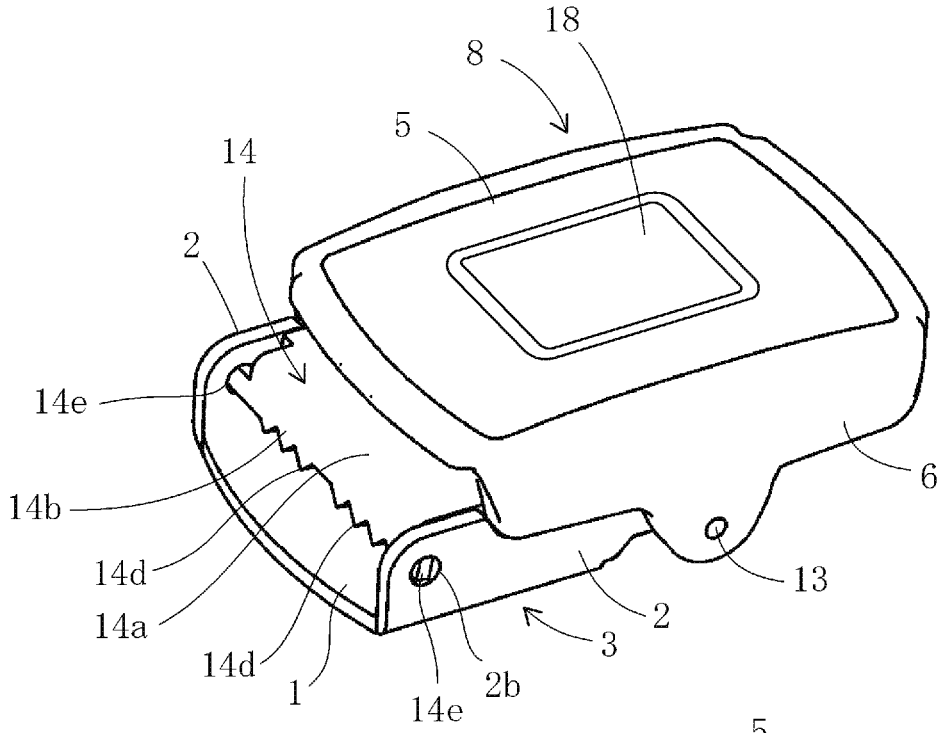
FIG. 2A is a perspective view of the belt buckle of FIG. 1 as seen obliquely from above.
Figure 2B:
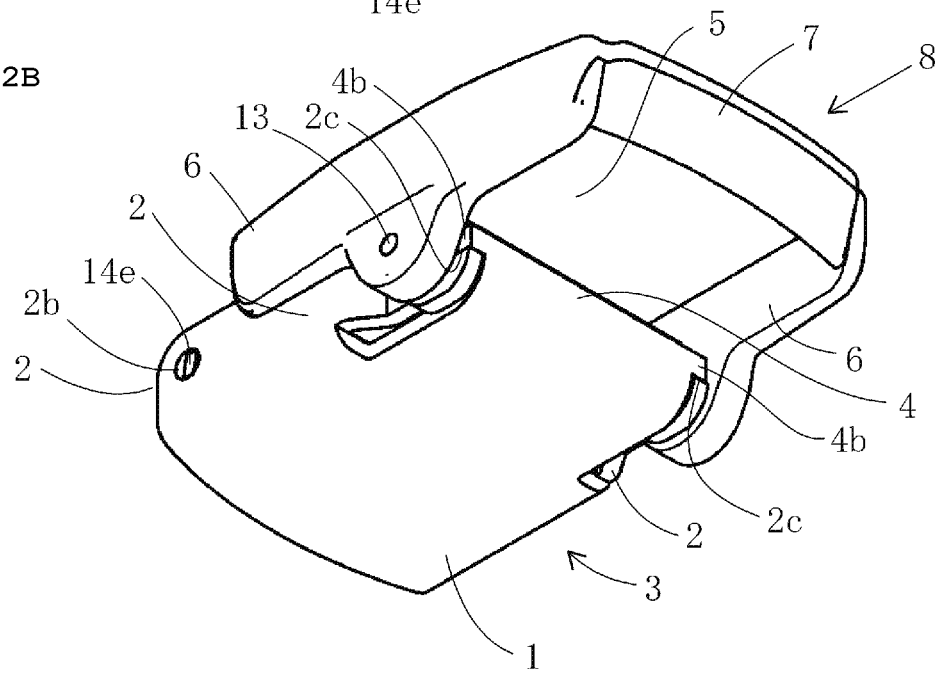
FIG. 2B is a perspective view of the belt buckle of FIG. 1 as seen obliquely from below.

FIG. 1 is an exploded perspective view of a belt buckle according to an embodiment of the present invention. FIG. 2A is a perspective view of the belt buckle of FIG. 1 as seen obliquely from above, and FIG. 2B is a perspective view of the belt buckle of FIG. 1 as seen obliquely from below.

Figure 3A:
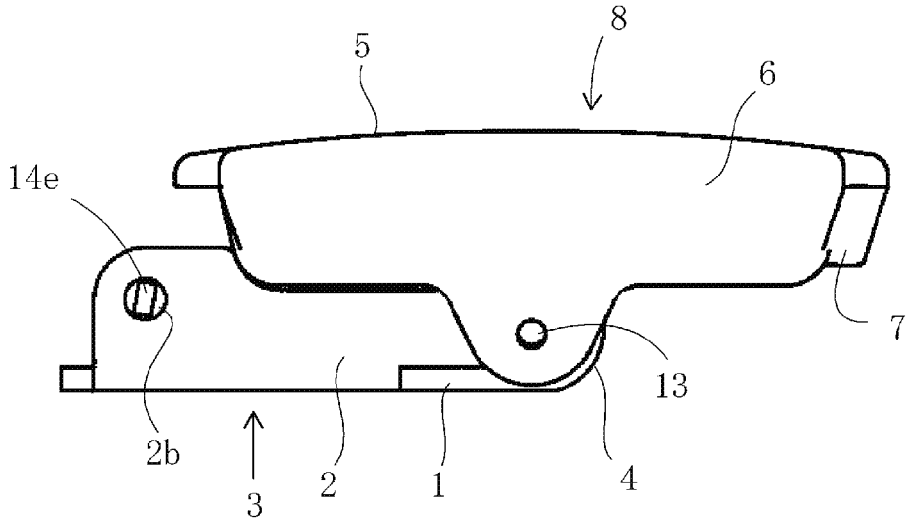
FIG. 3A is a side view of the belt buckle of FIG. 1, in which a cover member of the belt buckle is arranged at a closed position.
Figure 3B:
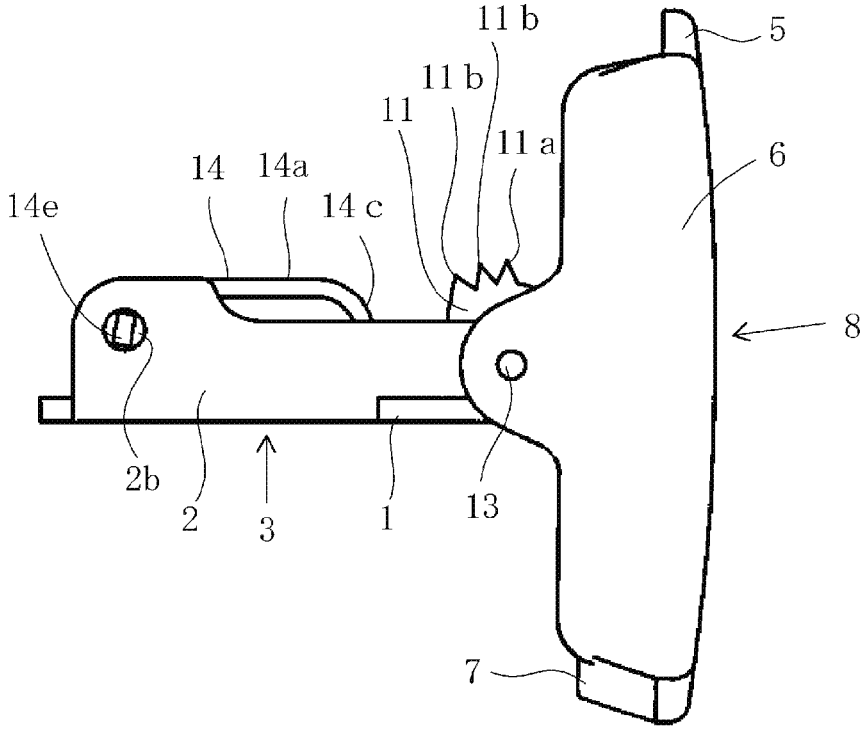
FIG. 3B is a side view of the belt buckle of FIG. 1, in which the cover member of the belt buckle is arranged at an opened position.
Figure 4A:
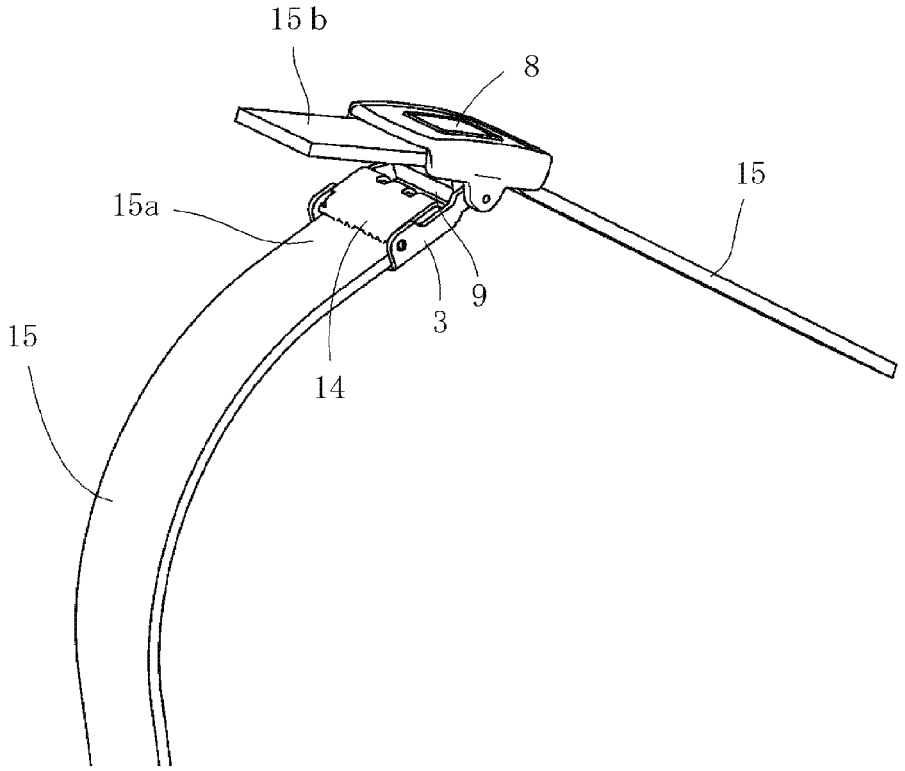
FIG. 4A is a perspective view of a belt provided with the belt buckle shown in FIG. 1.
Figure 4B:
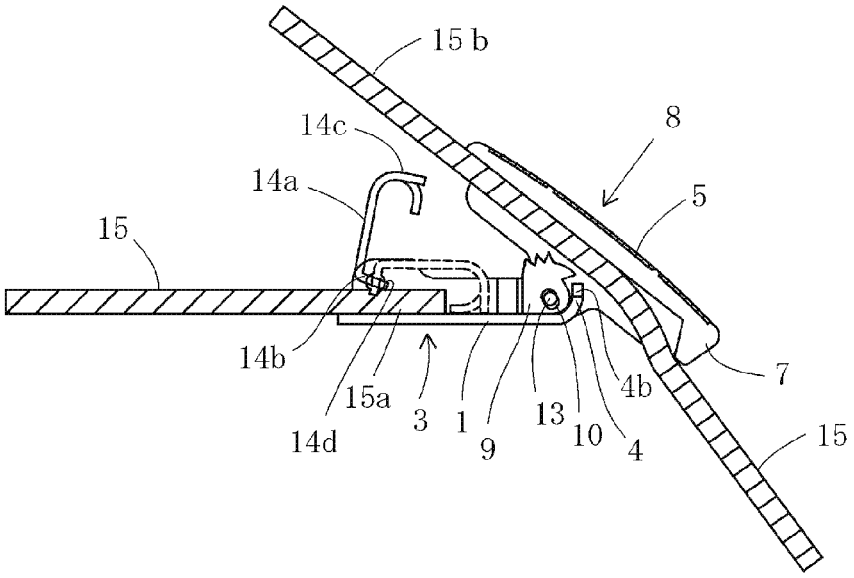
FIG. 4B is an enlarged sectional side view of the belt buckle of the belt of FIG. 4A.

FIG. 3A is a side view of the belt buckle of FIG. 1, in which a cover member of the belt buckle is arranged at a closed position, and FIG. 3B is a side view of the belt buckle of FIG. 1, in which the cover member of the belt buckle is arranged at an opened position. FIG. 4A is a perspective view of a belt provided with the belt buckle shown in FIG. 1, and FIG. 4B is an enlarged sectional side view of the belt buckle of the belt of FIG. 4A.

Referring to FIGS. 1 through 4, a belt buckle of the present invention comprises a base member 3 formed by a first bottom wall 1 whose width corresponds to that of a belt 15, a pair of first side walls 2 connecting to both sides of the first bottom wall 1, and a restraint wall 4 connecting to one end of the first bottom wall 1 and extending from the first bottom wall 1 on the same side as the first side walls 2.

Each of the first side walls 2 of the base member 3 has a step 2*c* on an upper corner thereof at the one end of the base member 3. On the other hand, the restraint wall 4 has protrusions 4*b* at its both sides in a width direction of the base member 3. Thus each of the protrusions 4*b* extends into the associated step 2*c* so as to be supported by the associated step 2*c* at an underside thereof.

The belt buckle also comprises a cover member 8 formed by a second bottom wall 5 which is wider than the first bottom wall 1, a pair of second side walls 6 connecting to both sides of the second bottom wall 5, and an engagement wall 7 connecting to one end of the second bottom wall 5 and extending between the second side walls 6. In this embodiment, the base member 3 is made of metal and the cover member is made of synthetic resin.

Each of the first side walls 2 of the base member 3 has a hole 2*a* at a side of the one end of the base member 3, and each of the second side walls 6 of the cover member 8 has a hole 6*a* at a middle of the cover member 8.

The cover member 8 and base member 3 overlap in such a way that interior surfaces of the cover member 8 and base member 3 are opposed to each other, and that the holes 2*a* and 6*a* are disposed in the same straight line (the engagement wall 7 protrudes outwardly from the restraint wall 4 in a longitudinal direction of the base member 3). Further, a pin 13 is inserted through the holes 2*a* and 6*a* so as to pivotally connect the cover member 8 and base member 3.

Thus the cover member 8 is rotatable around the pin 13 between a closed position (see, FIG. 3A) in which the cover member 8 overlaps with the base member 3 and an opened position (see, FIG. 3B) in which the cover member 8 separates from the base member 3.

The belt buckle also comprises a belt holding mechanism arranged at the base member 3 for cooperating with the second bottom wall 5 of the cover member 8 in such a way that the belt 15 inserted between the second side walls 6 is engaged between the belt holding mechanism and the interior surface of the second bottom wall 5 when the cover member 8 is arranged at the closed position, and for releasing the engagement of the belt 15 when the cover member 8 is arranged at the opened position.

The belt holding mechanism comprises the restraint wall 4 of the base member 3 and an elongated stopper member 9 mounted on the pin 13 so as to rotate around the pin 13 and extended between the first side walls 2.

In this embodiment, the stopper member 9, which is made of synthetic resin, has a flat bottom surface 9*a*, a pair of side surfaces 9*b*, 9*c* connecting to both sides of the bottom surface 9*a*, a pair of end surfaces 9*d*, 9*d* connecting to both ends of the bottom surface 9*a*, an upper surface 9*f* connecting the side surfaces 9*b*, 9*c* and the end surfaces 9*d*, 9*d*, and a through hole 10 extending through the end surfaces 9*d*, 9*d* in a longitudinal direction of the stopper member 9.

A transition portion 9*g* from one 9*b* of the side surfaces 9*b*, 9*c* to the bottom surface 9*a* forms a convex surface, and the side surface 9*b* faces toward the restraint wall 4, and the pin 13 passes through the through hole 10.

The stopper member 9 further has at least one first claw 11*a* and at least one second claw 11*b* provided on the top surface 9*f* of the stopper member 9. The first and second claws 11*a*, 11*b* are arranged on the same circumference having a predetermined point within the through hole 10 as its center in a cross-section of the stopper member 9. The first claw(s) 11*a* is(are) arranged closer to the restraint wall 4 than the second claw(s) in the rotary direction of the stopper member 9.

The through hole 10 has a cross-section in the form of a slot extending upwardly from the bottom surface 9*a* side to the second claw(s) 11*b* (in this embodiment, the outmost second claw 11*b*) side in such a manner that the stopper member 9 can be moved up and down along the through hole 10 while being rotated around the pin 13.

The stopper member 9 is further provided with a protrusion 12 at the side surface 9*b* thereof. The protrusion 12 controls the rotation of the stopper member 9.

The belt buckle further comprises a belt attachment mechanism 14 arranged at the other end of the base member 3 for fixing one end 15*a* of the belt 15 to the base member 3. In this embodiment, the belt attachment mechanism 14, which is made of metal, has a plate-like body portion 14*a* slightly narrower than the first bottom wall 1 of the base member 3, first and second wall portions 14*b*, 14*c* contacting to both sides of the body portion 14*a* and extending downward, teeth 14*d* provided along a lower edge of the first wall portion 14*b*, and pivots 14*e* provided on both sides of the first wall portion 14*b*.

The first side walls 2 of the base member 3 have holes 2*b* for receiving the pivots 14*e*, respectively on the side of the other end of the base member 3. The first and second wall portions 14*b*, 14*c* are arranged at the other end side and the one end side of the base member 3, respectively, and the pivots 14*e* are inserted the associated holes 2*b*, respectively. The belt attachment mechanism 14 can be rotated around an axes of pivots 14*e* between an opened position (see, the belt attachment mechanism drawn by solid lines in FIG. 4B) in which the body portion 14*a* stands on the first bottom wall 1 of the base member 3 and a gap for insertion of the belt 15 is formed between the first wall portion 14*b* and the first bottom wall 1 and a closed position (see, the belt attachment mechanism drawn by broken lines in FIG. 4B) in which the body portion 14*a* is parallel to the first bottom wall 1 and one end of the belt 15 inserted through the gap is engaged between the teeth 14*d* and the first bottom wall 1.

A method for using the belt buckle of the present invention is as follows. The belt 15 (hereinafter referred to as "belt body 15") is attached to the belt buckle. That is, the cover member 8 is arranged at the opened position, and the belt attachment mechanism 14 of the base member 3 is arranged at the opened position (see, a section drawn by solid lines in FIG. 4B). Then the one end 15*a* of the belt body 15 is inserted through the gap between the base member 3 (the first bottom wall 1) and the first wall portion 14*b* of the belt attachment mechanism 14, and the belt attachment mechanism 14 is rotated to the closed position, and thereby the one end 15*a* of the belt body 15 is secured to the base member 3 (see, a section drawn by broken lines in FIG. 4B).

Figure 5A:
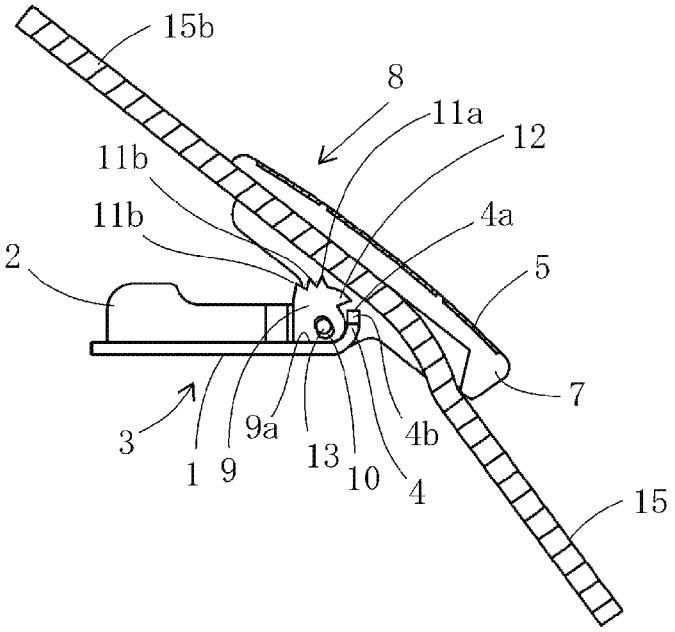
FIG. 5A is a side view with part broken illustrating an operation of the belt buckle of FIG. 1, in which the cover member of the belt buckle is arranged at the opened position.

Next, the belt body 15 is wound around a user's waist and, as shown in FIG. 5A, the other end 15*b* of the belt body 15 is inserted from the back side of the cover member 8 into a gap between the second bottom wall 5 of the cover member 8 and the stopper member 9 while being guided by the second side walls 6.

Figure 5B:
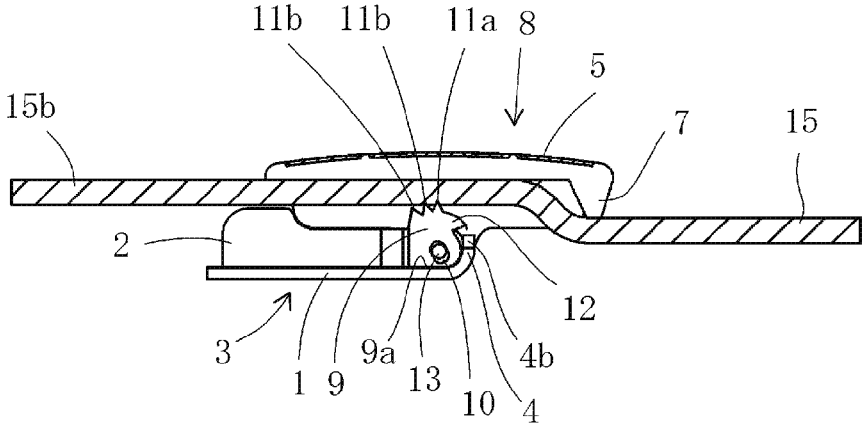
FIG. 5B is a side view with part broken away illustrating the operation of the belt buckle of FIG. 1, in which the cover member of the belt buckle is arranged at the closed position.

Then the winding length of the belt body 15 is adjusted and, as shown in FIG. 5B, the cover member 8 is rotated from the opened position to the closed position, and thereby, the first claw(s) 11*a* bite(s) into the belt body 15 while the stopper member 9 is kept at rest so that the belt body 15 is engaged between the first claw(s) 11*a* and the second bottom wall 5 of the cover member 8.

Figure 5C:
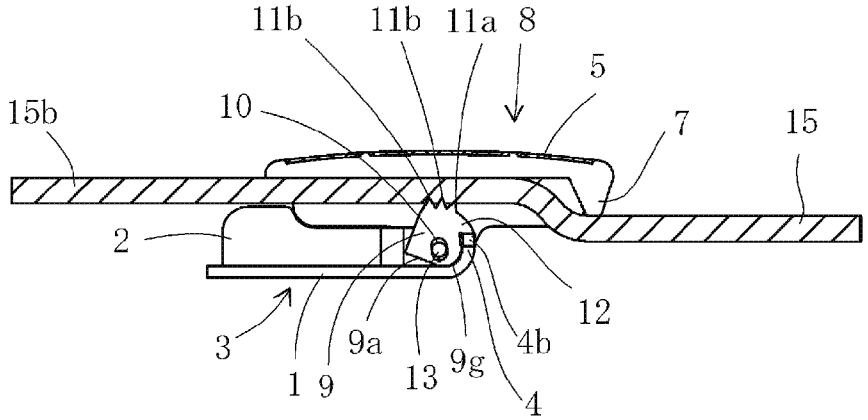
FIG. 5C is a side view with part broken away illustrating the operation of the belt buckle of FIG. 1, in which the cover member of the belt buckle is arranged at the closed position and the belt is secured to the belt buckle.

Further, the belt body 15 is pulled in a direction of drawing the belt body 15 out of the belt buckle, and, as shown in FIG. 5C, the stopper member 9 rotates toward the restraint wall 4 while bringing the transition portion 8*g* into contact with the first bottom wall 1 of the base member 3 and upwardly moves within the slot (the through hole 10) until the protrusion 12 abuts to an upper surface 4*a* of the restraint wall 4, and thereby the second claw(s) 11*b* bite(s) into the belt body 15 deeper than the first claw(s) 11*a* while the first claw(s) 11*a* separate(s) from the belt body 15 so that the belt body 15 is locked between the stopper member 9 and the cover member 8, and the belt body 15 is fastened around the user's waist.

At the same time, the belt body 15 is pressed by the top surface of the engagement wall 7 of the cover member 8 against the user's waist in such a way that the belt body 15 extends with curvature from the stopper member 9 to the top surface of the engagement wall 7. Thus the rotational moment rotating the cover member 8 toward the closed position is generated by the stress to the curvature of the belt body 15 so as to certainly hold the cover member 8 in the closed position.

Consequently, the belt body 15 is neither wound down nor detached from the user's waist while the belt body 15 is fastened around the user's waist.

When the belt body 15 is detached from the user's waist, the cover member 8 is rotated from the closed position to the opened position. The second claw(s) 11*b* of the stopper member 9 can be easily separated from the belt body 15 during this rotation of the cover member 8 because the stopper member 9 is kept rest by the abutment of the protrusion 12 to the restraint wall 4. Thereafter the stopper member 9 rotates in a direction opposite to the rotational direction of the cover member 8 until the bottom surface 9*a* contacts with the first bottom wall 1 of the base member 3, and returns to the position shown in FIG. 5A, and thereby the other end 15*b* of the belt body 15 can be easily drawn out of the cover member 8.

According to the present invention, a structure of a belt buckle becomes simpler than that of a conventional belt buckle because a biasing means such as a spring is not required and the number of components of the belt buckle is reduced. So the low-cost production of belt buckles is achieved.

Figure 6A:
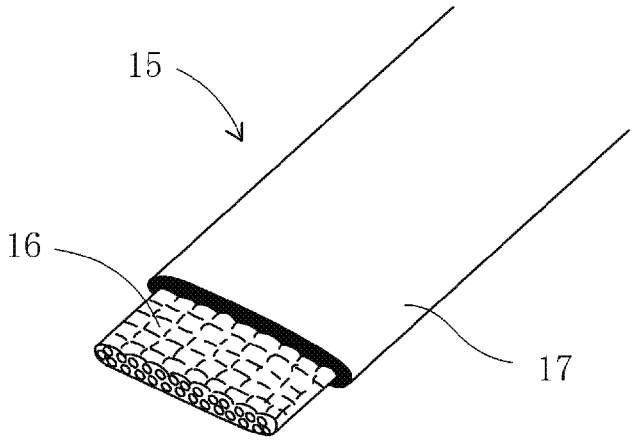
FIG. 6A is a perspective view with part broken away illustrating a belt body of a belt according to an embodiment of the present invention.
Figure 6B:
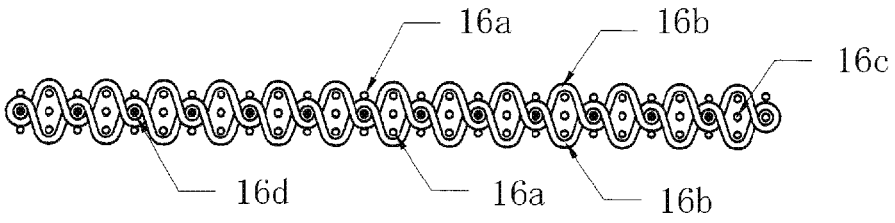
FIG. 6B is a sectional view illustrating a transversal weave structure of a core of the belt body of FIG. 6A.
Figure 6C:
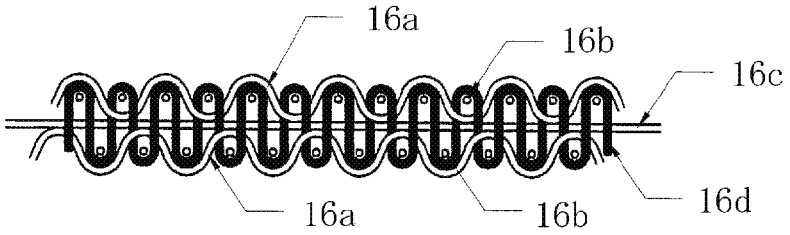
FIG. 6C is a sectional view illustrating a longitudinal weave structure of the core of the belt body of FIG. 6A.

FIG. 6A is a perspective view with part broken away illustrating a belt body of a belt according to an embodiment of the present invention. FIG. 6B is a sectional view illustrating a transversal weave structure of a core of the belt body of FIG. 6A. FIG. 6C is a sectional view illustrating a longitudinal weave structure of the core of the belt body of FIG. 6A.

Because a belt buckle of the belt according to this embodiment has the same structure as that of the belt buckle shown in FIGS. 1 through 5, the detailed explanation of the belt buckle is omitted in what follows.

With reference to FIG. 6A, the belt body 15 has a core 16 and a synthetic resin layer 17 covering the whole of the core 16. The core 16 is composed of a woven fabric consisting of twisted yarns of short fibers and the twisted yarns have a fluffed surface. In this embodiment, for example, tetronic twisted yarns or nylon twisted yarns are used as the twisted yarns.

Even though a weave structure of the woven fabric is not limited to particular ones, the woven fabric is preferably made by a flat double weave as shown in FIGS. 6B and 6C. In FIGS. 6B and 6C, the numeral 16*a* designates a warp, the numeral 16*b* designates a woof, the numeral 16*c* designates a core yarn and the numeral 16*d* designates a stitching yarn.

The synthetic resin layer 17 may be made of well-known thermoplastic resin such as vinyl chloride resin or urethan resin.

According to the present invention, it is possible to produce the belt body 15 by use of a molding process which includes supplying melted synthetic resin into a mold and continuously drawing the core 16 out of the mold, and thereby a production process of the belt body 15 becomes simpler than that of a conventional belt body, and thereby the cost of production of the belt body 15 is reduced.

Furthermore, the core 16 of the belt body 15 adheres tightly to the synthetic resin layer 17 because the core 16 has fluffed surface, and the belt body 15 has a level of flexibility and strength because the core 16 is composed of the woven fabric consisting twisted yarns of short fibers. Consequently, the belt provides good wear feeling and high durability.

The invention claimed is:

1. A belt buckle comprising:

a base member formed by a first bottom wall, a pair of first side walls connecting to both sides of the first bottom wall, and a restraint wall connecting to one end of the first bottom wall and extending from the first bottom wall on the same side as the first side walls;

a cover member formed by a second bottom wall which is wider than the first bottom wall, a pair of second side walls connecting to both sides of the second bottom wall, and an engagement wall connecting to one end of the second bottom wall and extending between the second side walls, the cover member and base member overlapping in such a way that interior surfaces of the cover member and base member are opposed to each other and the engagement wall protrudes outwardly from the restraint wall;

a pin extending through the first and second side walls in a width direction of the base member at a side of the one end of the base member so as to pivotally connect the cover member and base member, the cover member being rotatable around the pin between a closed position in which the cover member overlaps with the base member and an opened position in which the cover member separates from the base member;

a belt attachment mechanism arranged at the other end of the base member for fixing one end of a belt to the base member; and a belt holding mechanism arranged at the base member for cooperating with the second bottom wall of the cover member in such a way that the belt inserted between the second side walls is engaged between the belt holding mechanism and the interior surface of the second bottom wall when the cover member is arranged at the closed position, and for releasing the engagement of the belt when the cover member is arranged at the opened position, the belt holding mechanism comprising:

the restraint wall of the base member; and an elongated stopper member mounted on the pin so as to rotate around the pin and extended between the first side walls, the stopper member having:

a flat bottom surface;

a pair of side surfaces connecting to both sides of the bottom surface;

a pair of end surfaces connecting to both ends of the bottom surface;

an upper surface connecting the side surfaces and the end surfaces;

a through hole extending through the end surfaces in a longitudinal direction of the stopper member, a transition portion from one of the side surfaces to the bottom surface forming a convex surface, the one of the side surfaces facing toward the restraint wall, the pin passing through the through hole; and at least one first claw and at least one second claw provided on the top surface of the stopper member in such a way that the at least one first claw is arranged closer to the restraint wall than the at least one second claw in the rotary direction of the stopper member.

2. The belt buckle according to claim 1, wherein each of the first side walls of the base member has a step on an upper corner thereof at the one end of the base member, and wherein the restraint wall has protrusions at its both sides in a width direction of the base member, each of the protrusions extending into the associated step so as to be supported by the associated step at an underside thereof.

3. A belt comprising:

the belt buckle according to claim 1; and a belt body, the belt body having:

a core composed of a woven fabric consisting of twisted yarns of short fibers, the twisted yarns having a fluffed surface; and a synthetic resin layer covering the whole of the core.

* * * * *